US008720696B2

(12) United States Patent
Washburn

(10) Patent No.: US 8,720,696 B2
(45) Date of Patent: May 13, 2014

(54) SYSTEM AND METHOD FOR SEPARATION OF MATERIALS OF DIFFERENT SPECIFIC GRAVITIES

(76) Inventor: Klinton D. Washburn, Willard, UT (US)

( * ) Notice: Subject to any disclaimer, the term of this patent is extended or adjusted under 35 U.S.C. 154(b) by 0 days.

(21) Appl. No.: 13/542,845

(22) Filed: Jul. 6, 2012

(65) Prior Publication Data

US 2013/0008835 A1 Jan. 10, 2013

Related U.S. Application Data

(60) Provisional application No. 61/505,145, filed on Jul. 7, 2011.

(51) Int. Cl.
*B03B 5/02* (2006.01)
*B03B 5/74* (2006.01)

(52) U.S. Cl.
USPC ..... 209/439; 209/443; 209/444

(58) Field of Classification Search
USPC ..... 209/443, 444, 438, 439
See application file for complete search history.

(56) References Cited

U.S. PATENT DOCUMENTS

| | | | | | |
|---|---|---|---|---|---|
| 1,650,726 | A | * | 11/1927 | Stebbins | 209/467 |
| 2,091,620 | A | * | 8/1937 | Williams | 209/443 |
| 2,329,781 | A | * | 9/1943 | Overhultz | 209/438 |
| 2,944,668 | A | * | 7/1960 | Joseph | 209/443 |
| 3,941,690 | A | | 3/1976 | Powers et al. | |
| 3,951,787 | A | | 4/1976 | Duke | |
| 3,970,551 | A | | 7/1976 | Wright et al. | |
| 4,148,725 | A | | 4/1979 | Haight | |
| 4,173,519 | A | | 11/1979 | Parker et al. | |
| 4,199,441 | A | | 4/1980 | Ross | |
| 4,251,357 | A | | 2/1981 | Wright | |
| 4,265,743 | A | | 5/1981 | Younge | |
| 4,290,527 | A | | 9/1981 | Wright | |
| 4,319,985 | A | | 3/1982 | Hibbard | |
| 4,319,995 | A | | 3/1982 | Haight | |
| 4,360,424 | A | | 11/1982 | Pearson et al. | |
| 4,472,269 | A | | 9/1984 | Swick | |
| 4,525,270 | A | | 6/1985 | McCann | |
| 4,778,219 | A | * | 10/1988 | Wilczynski et al. | 299/8 |
| 4,826,251 | A | | 5/1989 | Balkus | |
| 4,946,586 | A | * | 8/1990 | Fletcher | 209/435 |
| 5,043,059 | A | * | 8/1991 | Ponomarev | 209/44 |
| 5,108,584 | A | | 4/1992 | Brosseuk | |
| 5,273,165 | A | * | 12/1993 | Krenzler | 209/434 |
| 5,275,294 | A | | 1/1994 | Krenzler | |
| 5,785,182 | A | | 7/1998 | Ashcraft | |
| 5,927,508 | A | | 7/1999 | Plath | |
| 6,799,681 | B1 | | 10/2004 | Warren | |
| 7,012,209 | B2 | | 3/2006 | Loewen | |

FOREIGN PATENT DOCUMENTS

| | | |
|---|---|---|
| JP | 08-033854 | 2/1996 |

* cited by examiner

*Primary Examiner* — David H Bollinger
(74) *Attorney, Agent, or Firm* — JP Webb; Jason P. Webb; Danny Y. H. Cheng

(57) ABSTRACT

A system, method and apparatus for separating materials of different specific gravities including a material flow-path surface having a trap structure with an oscillator coupled thereto to cause oscillation thereof while the surface is immersed in a standing fluid.

18 Claims, 9 Drawing Sheets

SYSTEM AND METHOD FOR SEPARATION OF MATERIALS OF DIFFERENT SPECIFIC GRAVITIES

CROSS-REFERENCE TO RELATED APPLICATIONS

This application claims priority from, under 35 U.S.C. §120, and incorporates by reference for any purpose the entire disclosure of, U.S. Provisional Patent Application No. 61/505,145 by Klinton D. Washburn, filed Jul. 7, 2011.

BACKGROUND

1. Technical Field

The present application relates generally to systems and methods for material separation and more particularly, but not by way of limitation, to systems and methods for material separation utilizing motion to induce separation of materials with different specific gravities.

2. History of Related Art

Current techniques typically accomplish separation of materials of different specific gravities via pulsing or flowing media, such as water or air, to move lower specific-gravity materials away from higher specific-gravity materials. Smaller particles of higher specific-gravity materials are difficult to recover using current techniques.

The inventions heretofore known suffer from a number of disadvantages which include but are not limited to failing to separate out smaller particles, requiring great amounts of fluid, requiring great amounts of energy, being large, heavy, expensive, inefficient, not permitting use in areas where water is not readily available, damaging the environment, requiring chemicals, requiring regular attention by operators, leaking valuable materials, requiring a great deal of expertise to operate, being difficult to clean, and requiring a great deal of post-processing and/or refinement of materials after separation is concluded.

What is needed is a system and/or method that solves one or more of the problems described herein and/or one or more problems that may come to the attention of one skilled in the art upon becoming familiar with this specification.

SUMMARY

The present invention has been developed in response to the present state of the art, and in particular, in response to the problems and needs in the art that have not yet been fully solved by currently available methods and systems. Accordingly, the present invention has been developed to provide a method and system for material separation of materials of different specific gravities.

There may be a system for separating materials of different specific gravities, including one or more of: material feed device that may be configured to feed particulate material; a material flow-path surface that may be in communication with a material feed device such that particulate material fed therefrom is received by the material flow-path surface, wherein the material flow-path surface may include a material trap structure; and/or an oscillator that may be functionally coupled to the material flow-path surface and/or may be configured to cause the material flow-path surface to oscillate. It may be that the system does not include a flowing fluid in communication therewith.

There may be a method of separating materials of different specific gravities, that may include one or more of the steps of: feeding particulate material onto a material flow-path surface that may have a material trap structure, wherein the material flow-path surface may be immersed in a standing (substantially still/non-moving, such that particles are not substantially induced to move by the flow thereof) fluid; and/or oscillating the material flow-path surface, thereby trapping heavier particles within the material trap structure. It may be that the standing fluid is selected from the group of fluids consisting of: air, water, and oil.

There may be a material separation apparatus, that may include one or more of: an oscillation module that may be configured to impart an oscillating force; a control module that may be functionally coupled to the oscillation module and/or may be configured to control operation of the oscillation module; and/or a surface that may have a material trap, wherein the surface may be functionally coupled to the oscillation module such that it is thereby oscillated.

According to one embodiment of the invention, there is a system for separating materials of different specific gravities. The system may include a material feed device that may be configured to feed particulate material. The material feed device may be positioned in relation to the material flow path surface to deposit particulate material in a top center region of the material flow path surface.

The system may include a material flow-path surface in communication with the material feed device such that particulate material fed therefrom may be received by the material flow-path surface, wherein the material flow-path surface may include a material trap structure. The material flow path surface may be submerged in a non-flowing fluid bath. The material flow path surface may be in the shape of a conical disc. The material flow path surface may include a plurality of nested circular discs. The material flow path surface may include a sloped surface leading to a plurality of successive material collection repositories. The material flow path surface may include a conical disc sloping downwardly from its center and may have a continuous trough about the edge region thereof, the continuous trough may have an inward-facing lip.

The system may include an oscillator that may be functionally coupled to the material flow-path surface and configured to cause the material flow-path surface to oscillate, wherein the system does not include a flowing fluid in communication therewith. The oscillator may cause rotational oscillation of the material flow path surface.

According to one embodiment of the invention, there is a method of separating materials of different specific gravities. The method may include the step of feeding particulate material onto a material flow-path surface having a material trap structure, wherein the material flow-path surface may be immersed in a standing fluid. The step of feeding particulate material may include feeding particulate material into a central region of a flow path surface that slopes downwardly therefrom. The step of feeding particulate material may include feeding particulate material into a central region of a flow path surface that slopes downwardly therefrom and wherein the step of oscillating may include rotational oscillating.

The method may include oscillating the material flow-path surface, thereby trapping heavier particles within the material trap structure. The step of oscillating may include both rotational and vertical oscillating. The step of oscillating may include rotational oscillating. The material flow path surface may include a circular disc that may be sloped downwardly from its center and may include a continuous trough about the edge region thereof, the continuous trough may have an inward-facing lip. The standing fluid may be selected from the group of fluids consisting of: air, water, and oil.

According to one embodiment of the invention, there is a material separation apparatus. The apparatus may include an oscillation module that may be configured to impart an oscillating force. The oscillator may cause rotational oscillation of the disc. The apparatus may include a control module that may be functionally coupled to the oscillation module and configured to control operation of the oscillation module. The apparatus may include a surface that may have a material trap that may be functionally coupled to the oscillation module such that it may thereby oscillated. The surface may include conic disc that may have a series of successive material collection repositories that may have inward facing lips. The surface may further include an array of nested conic discs. The apparatus may include a tank of standing fluid that may be disposed about the surface, the surface being submerged therein.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION

Figure 1:
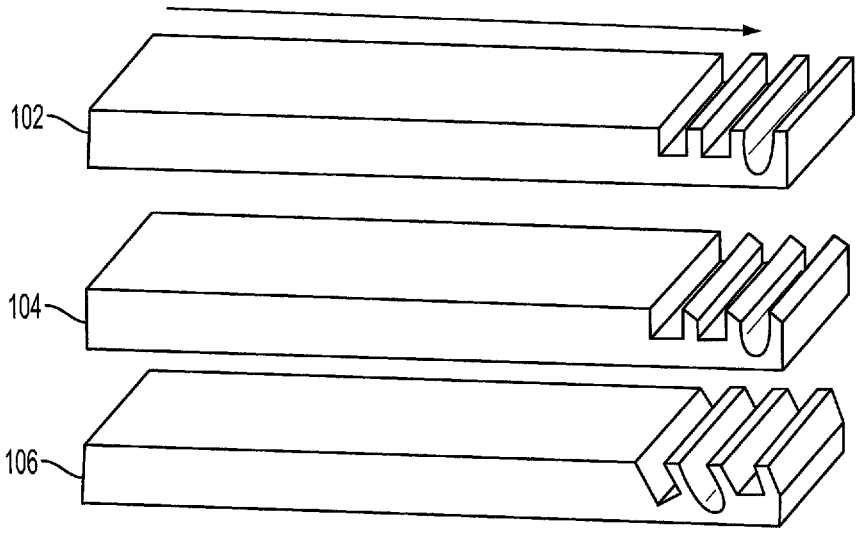
FIG. 1 illustrates perspective views of a plurality of embodiments of a material flow-path surface.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of programmable or executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module and/or a program of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The various system components and/or modules discussed herein may include one or more of the following: a host server or other computing systems including a processor for processing digital data; a memory coupled to said processor for storing digital data; an input digitizer coupled to the processor for inputting digital data; an application program stored in said memory and accessible by said processor for directing processing of digital data by said processor; a display device coupled to the processor and memory for displaying information derived from digital data processed by said processor; and a plurality of databases. Various databases used herein may include: equipment specification tables, location metadata tables, processing parameter tables, oscillation change tables, processing schedules, and/or like data useful in the operation of the present invention. As those skilled in the art will appreciate, any computers discussed herein may include an operating system (e.g., Windows Vista, NT, 95/98/2000, OS2; UNIX; Linux; Solaris; MacOS; and etc.) as well as various conventional support software and drivers typically associated with computers. The computers may be in a home or business environment with access to a network. In an exemplary embodiment, access is through the Internet through a commercially-available web-browser software package.

The present invention may be described herein in terms of functional block components, screen shots, user interaction, optional selections, various processing steps, and the like. Each of such described herein may be one or more modules in exemplary embodiments of the invention. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, the software elements of the present invention may be implemented with any programming or scripting language such as C, C++, Java, COBOL, assembler, PERL, Visual Basic, SQL Stored Procedures, AJAX, extensible markup language (XML), with the various algorithms being implemented with any combination of data structures, objects, processes, routines or other programming elements. Further, it should be noted that the present invention may employ any number of conventional techniques for data transmission, signaling, data processing, network control, and the like. Still further, the invention may detect or prevent security issues with a client-side scripting language, such as JavaScript, VBScript or the like.

Additionally, many of the functional units and/or modules herein are described as being "in communication" with other functional units and/or modules. Being "in communication" refers to any manner and/or way in which functional units and/or modules, such as, but not limited to, computers, laptop computers, PDAs, modules, and other types of hardware and/or software, may be in communication with each other. Some non-limiting examples include communicating, sending, and/or receiving data and metadata via: a network, a wireless network, software, instructions, circuitry, phone lines, internet lines, satellite signals, electric signals, electrical and magnetic fields and/or pulses, and/or so forth.

As used herein, the term "network" may include any electronic communications means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, transponder communications, local area network (LAN), wide area network (WAN), networked or linked devices and/or the like. Moreover, although the invention may be implemented with TCP/IP communications protocols, the invention may also be implemented using IPX, Appletalk, IP-6, NetBIOS, OSI or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

Any or all of the operational portions described herein may be operated, controlled, managed, initiated, and/or caused to terminate the operation thereof by one or more modules, control modules, databases, controls, and/or the like and combinations thereof. As a non-limiting example, there may be a control module that may control operation of an oscillator (oscillating device) according to a schedule, script, table, and/or the like that may cause the oscillator to oscillate in varying manners over a period of time and/or in response to one or more detected characteristics of the method/system/apparatus, such as but not limited to information obtained through one or more sensors, transducers, and/or data gathering modules, such as but not limited to measuring modules that may measure one or more characteristics (weight, temperature, flow rate, density, color, reflectivity, conductivity, thermal conductivity, volume, material volume processed, and etc.) at one or more points or portions of a system/method/apparatus or flow stream. As a non-limiting example, there may be a control module that may instruct an oscillator to oscillate assymetrically to drive heavy materials into a plurality of traps until a particular weight or other characteristic is measured in the trap or otherwise and then cause the oscillator to change oscillation to drive the apparatus to empty, clean or otherwise change its mode of operation, while also causing a feed device to stop feeding new material. Once cleaned or emptied, the control module may detect the same and then revert to a previous operational state.

Various embodiments of the invention, such as, for example, those illustrated in FIGS. 6-7 and 8-9, use motion and gravity to separate materials having different specific gravities. In this regard, particles of various materials are put in motion. Higher specific-gravity particles in motion are caused to displace lower specific-gravity particles in particular material-collection repositories. This displacement of lower specific-gravity particles by higher specific-gravity particles permits more particles with higher specific gravity to be recovered. In typical embodiments, higher and lower specific-gravity materials move around each other such that, responsive to induced motion and gravity, the lower specific-gravity materials trend upward and the higher specific-gravity materials trend downward relative to one another. In various embodiments, the higher specific-gravity materials are captured in the material-collection repository (e.g., a cavity or trough) and lower specific-gravity materials are displaced over an edge of the material-collection repository.

In various embodiments of the invention, shaking, rotating, reciprocating, and other motions can be used to achieve material movement. The motions can be effected in geometries such as, for example, linear, angular, spiral, exponential, sinusoidal etc. Separation of lower specific-gravity materials and higher specific-gravity materials can occur in a dry environment or in other media such as water (e.g., freshwater, saltwater), oil, or various solutions. Submersion in such other media often serves to lower surface tension so that material particles move around each other more effectively and in some situations can serve to dissolve or disarticulate organic materials.

To capture targeted higher specific-gravity materials (e.g., gold, iron), a material-collection repository, which can include, for example, a cavity, trough, depression, gutter, channel, groove, or indention, is placed along a path of material flow. In a typical embodiment, as material enters the material-collection repository, higher specific-gravity materials tend to work their way down (i.e., responsive to gravity) and displace lower specific-gravity materials such that the lower specific-gravity materials are pushed up (i.e., opposite the direction of gravity) and out of an edge of the material-collection repository and are caused to flow away from the material-collection repository. It will be appreciated that, in some applications, a desired material is a higher specific-gravity material and in others the desired material is a lower specific-gravity material. In other cases, both or neither of the higher specific-gravity material and the lower-specific gravity material may be desired, in which case mere separation of the materials could be objective. Many different system configurations can be used without departing from principles of the invention, such as, for example, level surfaces and sloped surfaces, as will be discussed in more detail below.

Referring now generally to FIGS. 1-5, various different configurations can be employed to form a material flow-path surface. In various embodiments that employ a level material flow-path surface with material-collection repositories, the material-collection repositories can have geometries such as, for example, simple square tops, angled tops, rounded bottoms, and sloped walls. The term level refers to a surface that is normal to the direction of gravity. The term sloped refers to a surface that is not normal to the direction of gravity. In each of FIGS. 1-5, arrows indicate a primary direction of material flow along one or more material flow-path surfaces in accordance with principles of the invention. The material-collection repositories can be linear, radial, spiral or otherwise configured.

FIG. 1 illustrates three embodiments of material flow-path surfaces that each include a flat surface and a plurality of material-collection repositories near an end of the material flow-path surface. Material flow-path surfaces 102, 104, and 106 are illustrated in FIG. 1. In some embodiments of the invention, ridges as shown in FIG. 1 are used to form the material-collection repositories, the material-collection repositories illustrated in FIG. 1 being a series of three successive grooves defined. The ridges used to form the material-collection repositories may be angled as shown in the material flow-path surface 106 to form angled material-collection repositories and may also be angled at an uppermost portion thereof as shown in the material flow-path surface 104. In contrast, the material flow-path surface 102 illustrates three successive material-collection repositories, each of which is bounded by a substantially rectangular ridge. Angling the ridges, as in the material flow-path surface 106, can be used to impede flow of a higher specific-gravity material captured within a given material-collection repository to outside of the material-collection repository, while angled uppermost portions of ridges as shown in the material flow-path surface 104 can be used to facilitate flow of a lower specific-gravity material that escapes from a preceding material-collection repository into a succeeding material-collection repository.

In addition to the above, FIG. 1 illustrates that different configurations of the depths and profiles of the material-collection repositories can be employed. In particular, each of the material flow-path surfaces 102, 104, and 106 possess grooves that have, for example, various depths as well as rounded lower surfaces and perpendicular lower surfaces in relation to preceding and succeeding ridges bounding the respective groove. It will also be appreciated that the material flow-path surfaces could be employed in sloped or level configurations as dictated by design constraints.

When trying to separate heavy particles, such as but not limited to gold, many methods use flowing fluids, which incorporate fluid dynamic principles, which can be extremely complicated and situational. Accordingly, use of such methods and systems becomes problematic, subject to failure and inconsistent results. The present method is more reliable. Further, it provides many benefits not found in systems that require the use of flowing fluids. Standing fluids may be useful in reducing the tendency of particles to adhere to one another and/or in making the particles more likely to move under other influence, while still limiting the influence of the fluid on the motion of the particles. Wherein the particles are on a surface/bed/path/platform/etc. that is oscillating or otherwise subject to oscillating motion, the particles enter a state of liquefaction, wherein they behave more like a liquid and thereby the lighter particles will tend to rise while the heavier will tend to sink.

Figure 2:
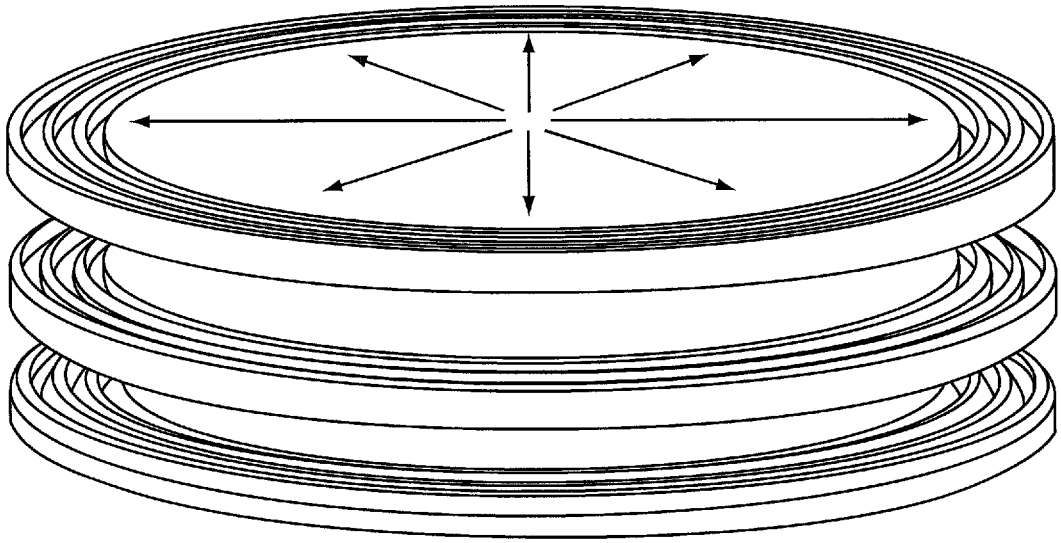
FIG. 2 is a perspective view of a plurality of stacked circular disks including a plurality of concentric material-collection repositories.

FIG. 2 illustrates an embodiment in which circular discs used as material flow-path surfaces and that include a plurality of concentric material-collection repositories (e.g., grooves) adjacent an outer circumference of the circular discs. As shown in FIG. 2, the circular discs are level and would be employed in a system that utilizes rotational movement about a central axis of the circular discs so that, for example, materials placed onto a central area of the circular discs would migrate outward toward a periphery of the circular discs and be caught in the grooves in accordance with principles of the invention.

In one non-limiting example, a disk may be constructed by machining materials such as aluminum or plastic, molding plastics or composites, and/or by shaping deformably elastic materials such as but not limited to metals. A disk may be mounted to a center axis and/or constrained to a center of rotation by pivots, rollers, or etc. around the perimeter, or suspended by springs or rods and rotationally shaken around the center of mass, etc.

Figure 3:
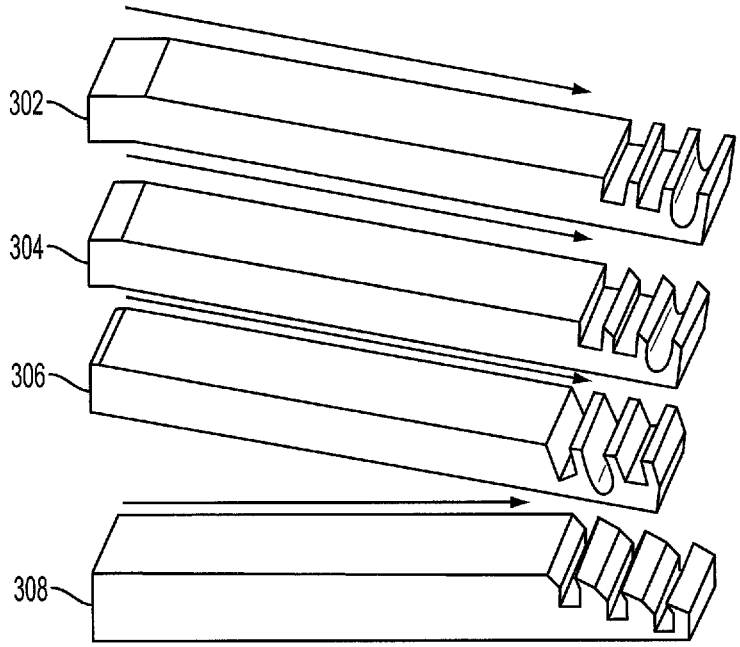
FIG. 3 illustrates perspective views of a plurality of embodiments of a sloped material flow-path surface.

In FIG. 3, embodiments of material flow-path surfaces that include a sloped surface and a plurality of material-collection repositories (e.g., grooves) near an end of the material flow-path surface are shown. FIG. 3 illustrates material flow-path surfaces 302, 304, 306, and 308. Each of the material flow-path surfaces 302, 304, and 306 is sloped downward in the direction of material flow in a region leading up to a plurality of successive material-collection repositories as illustrated by the arrows of FIG. 3. It will be apparent that the material-collection repositories of the material flow-path surfaces 302, 304, and 306 are similar to those of the material flow-path surfaces 102, 104, and 106, respectively.

The material flow-path surface 308 includes is level in the direction of material flow in a region leading up to a plurality of successive material-collection repositories (e.g., grooves). In contrast to the material flow-path surfaces 302, 304, and 306, the material flow-path surface 308 includes a plurality of grooves formed by ridges rounded surfaces that come to a relatively sharp point in a direction opposed to the direction of material flow.

Figure 4:
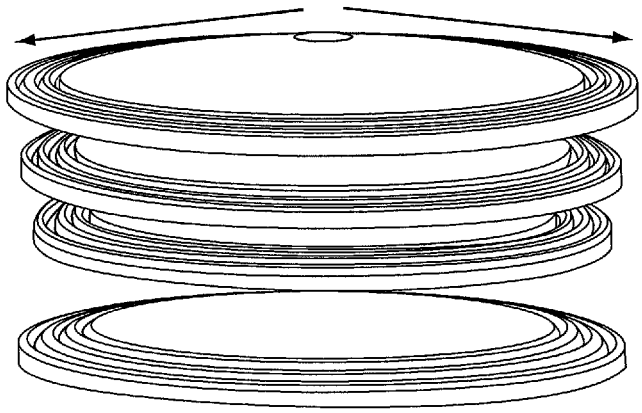
FIG. 4 is a perspective view of a plurality of circular disks with a sloped surface and a plurality of concentric material-collection repositories.

FIG. 4 illustrates a plurality of material flow-path surfaces in the form of circular discs. The circular discs of FIG. 4 could be employed in similar fashion to those shown in FIG. 2. As in FIG. 2, the circular discs each include a plurality of concentric material-collection repositories (e.g., grooves) adjacent an outer circumference of the circular disc and that slope from a center of the circular disc toward the material-collection repositories. In addition, and in contrast to the circular discs shown in FIG. 2, the circular discs of FIG. 4 each slope downward from a disc center to the material-collection regions.

Figure 5:
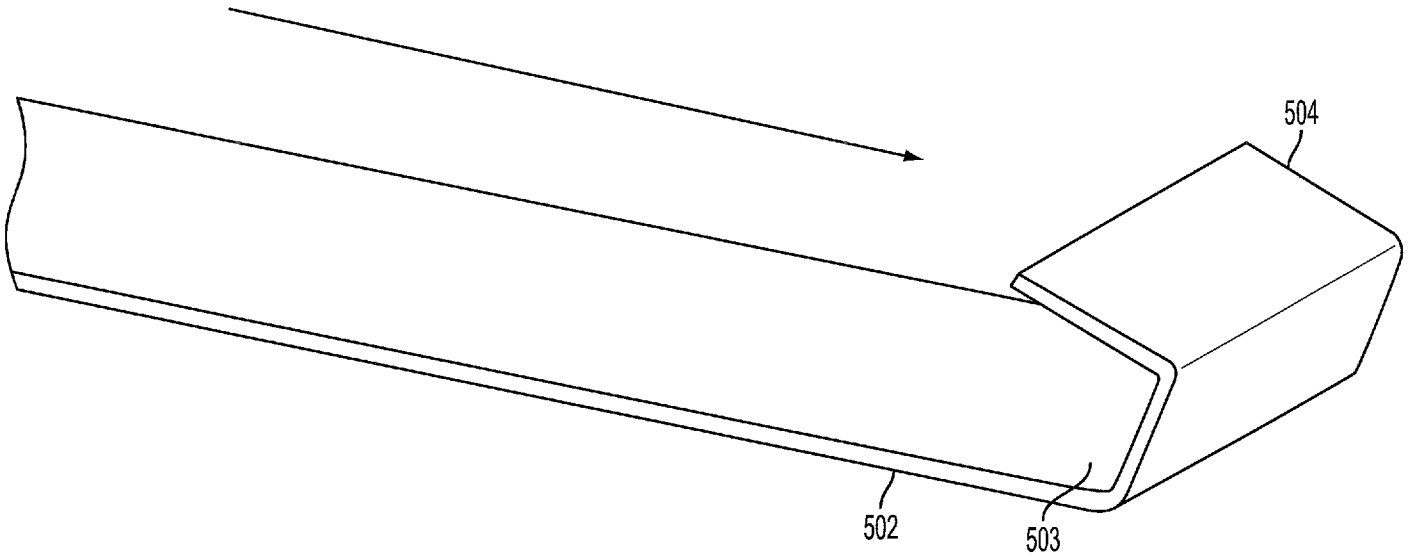
FIG. 5 is a perspective view of a material flow-path surface.

FIG. 5 illustrates a material flow-path surface 502 formed of sheet metal and having a material-collection repository 503 (e.g., trough) formed adjacent to an end thereof via bends in the sheet metal. As above, an arrow illustrates a direction of material flow. Many different materials can be used in various embodiments of the invention, such as, for example, milled materials, molded materials, and formed materials such as sheet metal. The material-collection repository 503 includes a lip 504 that projects generally in a direction opposite a direction of material flow. The lip 504 defines an upper boundary of the material-collection repository 503 and serves to impede flow of material that has collected in the material-collection repository 503 from out of the material-collection repository 503.

Figure 6:
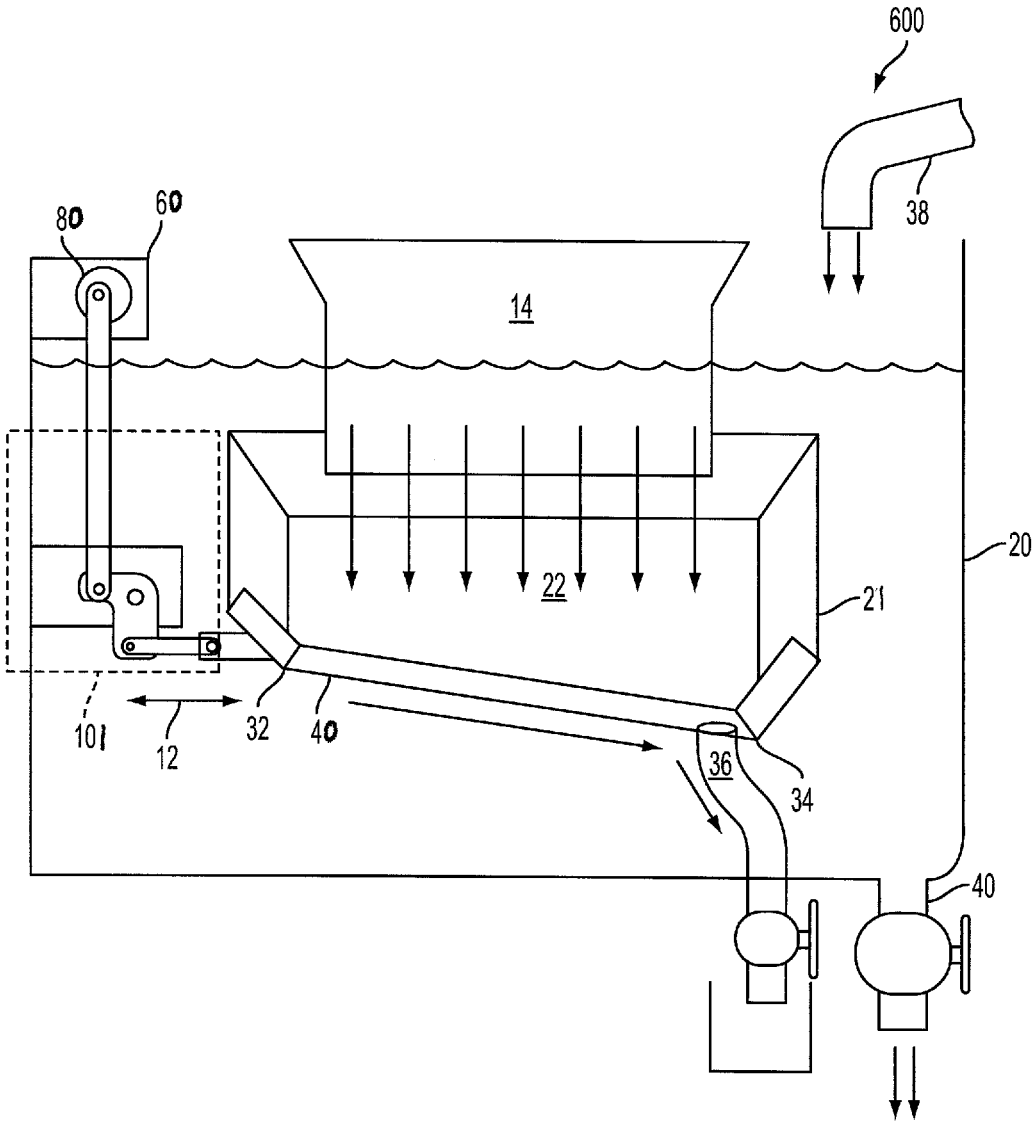
FIG. 6 is a partial cross-sectional front view of a system for separating materials having different specific gravities.
Figure 7:
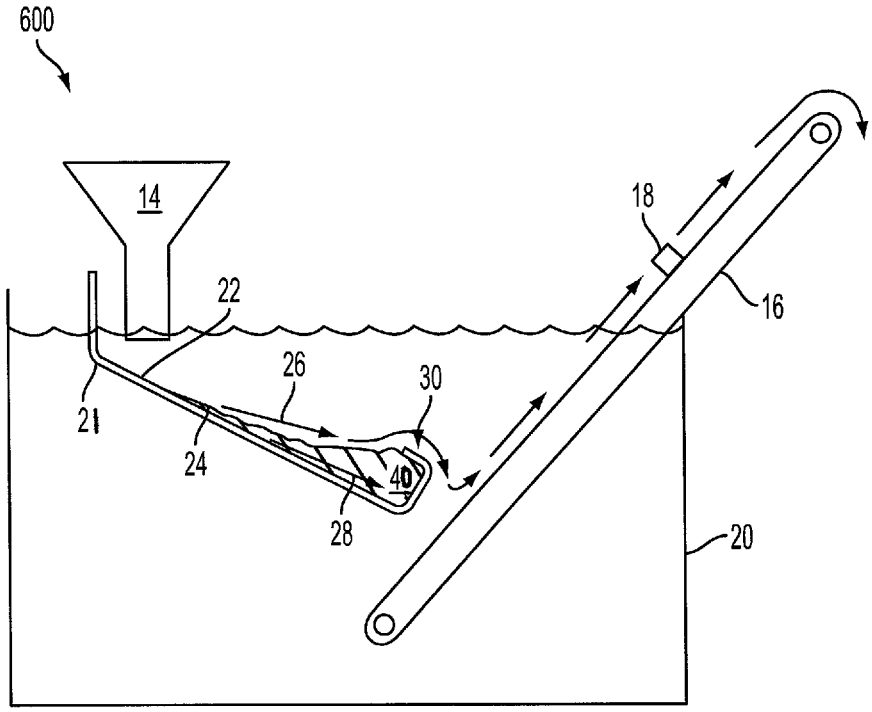
FIG. 7 is a partial cross-sectional side view of the system of FIG. 6.

Examples of operation of various embodiments of the invention will now be described below. A first example is illustrated in FIGS. 6-7. In the example illustrated by FIGS. 6-7, a sheet-metal material flow-path surface including a material-collection repository similar to that of FIG. 5 is used.

FIGS. 6-7 illustrate a system 600 that can be used to separate materials of different specific gravities. FIG. 6 is a partial front view of the system 600 and FIG. 7 is a partial cross-sectional side view of the system 600. Various features of the system 600 are for purpose of clarity shown in only one of FIGS. 6 and 7.

Referring specifically now to FIGS. 6-7, the system 600 includes a sheet-metal material flow-path surface 21 that includes angled portions that form a material-collection repository 40 adjacent a lower end of the sheet-metal material flow-path surface 21. In the system 600, the material-collection repository 40 is shown to be a trough similar to that shown in FIG. 5. The system 600 also includes a motion-imparting mechanism, shown as a motor 60 that includes a cam 80. It will be apparent that any appropriate motion-imparting mechanism may be employed, whether operable electrically, hydraulically, pneumatically, via internal combustion, or otherwise. The motor 60 and linkages 101 between the motor 60 and the sheet-metal material flow-path surface 21 impart a side-to-side motion 12 to the sheet-metal material flow-path surface 21; however, other types of motions can be employed as dictated by design constraints. The system 600 also includes a hopper 14 that feeds the material to the sheet-metal material flow-path surface 21 and a wet belt 16 that removes lower specific-gravity materials 18 from a tank 20 within which at least part of the sheet-metal material flow-path surface 21 is contained. A lower portion of the hopper 14 may or may not be below the level of liquid in the tank 20. The tank 20 is illustrated in FIGS. 6-7 as being filled with a liquid, although the tank 20 need not necessarily be so filled. In other embodiments, no tank is utilized.

The material is fed from the hopper 14 onto the sheet-metal material flow-path surface 21 near an upper portion 22 of the sheet-metal material flow-path surface 21. The motor 60, in a typical embodiment, imparts, via the linkages 101, the side-to-side motion 12 in a sinusoidal fashion to the sheet-metal material flow-path surface 21. After the material is in contact with the sheet-metal material flow-path surface 21, the material propagates, by virtue of the motion and gravity, down the sheet-metal material flow-path surface 21 toward the material-collection repository 40. As the material moves down the sheet-metal material flow-path surface 21, a portion 24 of the material is deposited on the sheet-metal material flow-path surface 21. As more of the material moves down the material flow-path surface 21, and some of the material is deposited into the material-collection repository 40, lower specific-gravity material present in the material-collection repository 40 is pushed upward as indicated by arrow 26 by movement of the higher specific-gravity material into the material-collection repository 40 as indicated by arrow 28. As more of the material is fed onto the sheet-metal material flow-path surface 21, some of the material begins to fill the material-collection repository 40 in a manner such that entry of the higher specific-gravity material into the material-collection repository 40 displaces the lower specific-gravity material in the material-collection repository 40 and eventually the thus-displaced lower specific-gravity material is raised to a level above a material-collection-repository edge 30 and falls onto the wet belt 16. The wet belt 16 operates to transport the material that falls onto the wet belt 16 out of the tank 20. It will be understood that any appropriate mechanism, such as, for example, an auger, elevator, or other aggregate material-removal system can be used in addition to or instead of the wet belt 16.

To minimize the need for periodic removal of accumulated higher specific-gravity material from the material-collection repository 40, a lower end of the sheet-metal material flow-path surface 21 is sloped downwardly between a point 32 and a point 34 thereof as illustrated in FIG. 6 and a higher-specific-gravity material outlet 36 is placed near the point 34. The higher-specific-gravity material outlet 36 can be used to provide a continuous feed of higher specific-gravity material that has built up in the material-collection repository 40. Instead of, or in addition to, sloping between the points 32 and 34, an asymmetric motion can be applied to the material flow-path surface 21 to urge the material toward the higher-specific-gravity material outlet 36. To keep the liquid from becoming too saturated with suspended lower specific-gravity material, a clean liquid feed 38 and a cloudy liquid outlet 40 are provided to allow an exchange of liquid (e.g., water) as needed.

Figure 8:
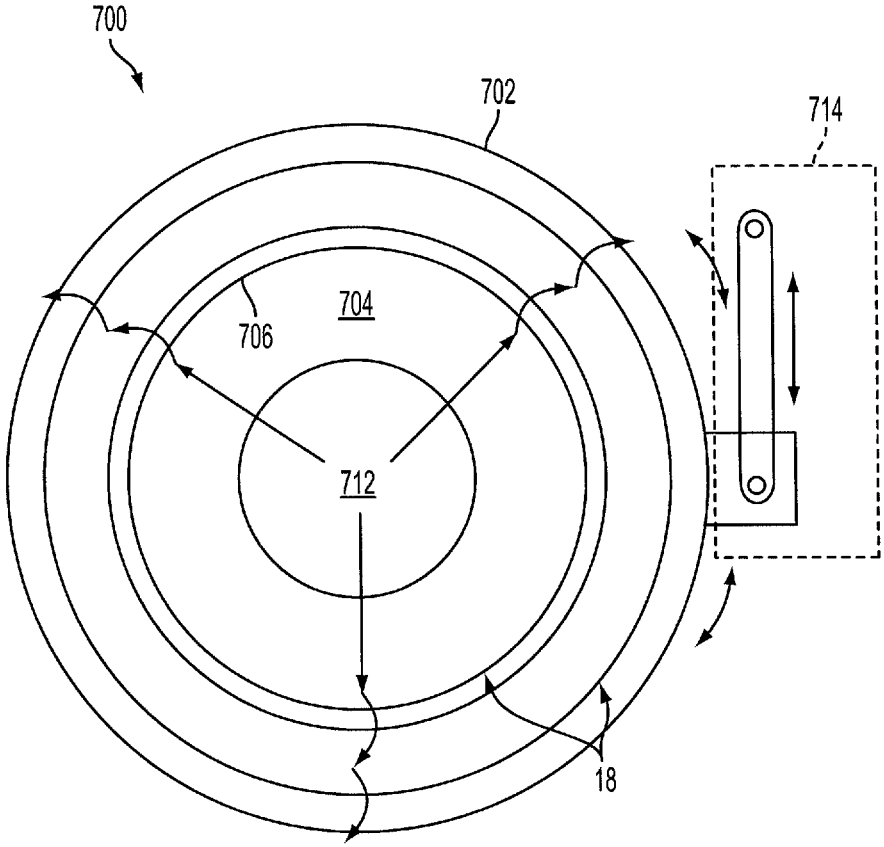
FIG. 8 is a top view of a portion of a radial system for separating materials having different specific gravities.
Figure 9:
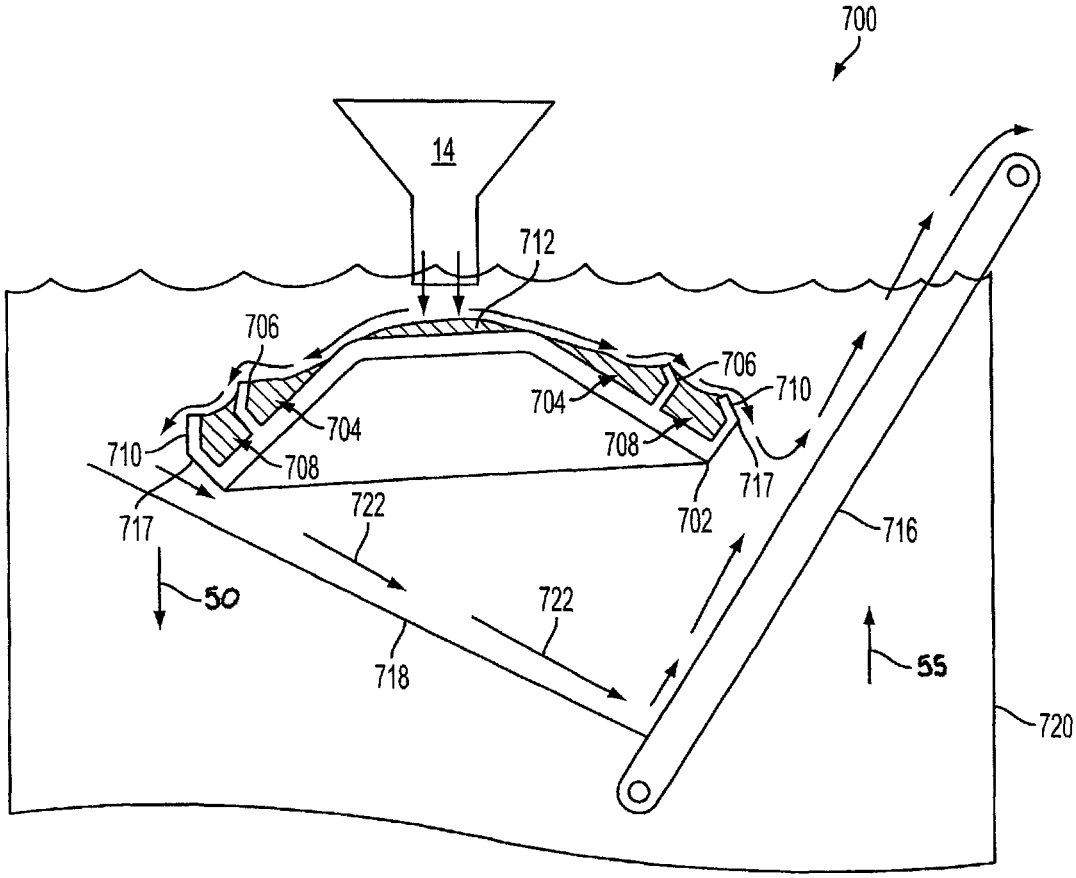
FIG. 9 is a partial cross-sectional side view of the radial system of FIG. 8.

FIGS. 8-9 illustrate a radial system 700 that can be used to separate materials of different specific gravities. FIG. 8 is a partial top view of the radial system 700. FIG. 9 is a partial cross-sectional side view of the radial system 700. It will be understood that some features of the radial system 700 are for purposes of clarity of illustration shown in one but not both of FIGS. 8 and 9.

The radial system 700, which operates in many ways similarly to the system 600, includes a material flow-path surface in the form of a circular disc 702. The circular disc 702 includes a continuous material-collection repository 704 (e.g., trough) formed by a continuous edge 706 having an inward-facing lip. The circular disc 702 also includes a continuous material-collection repository 708 (e.g., trough) formed by a continuous edge 710 having an inward-facing lip similar to that of the continuous edge 706. The continuous material-collection repository 708 is concentric to and of greater circumference than the continuous material-collection repository 704. As is apparent from FIG. 9, the lip of each of the continuous edges 706 and 710 is shaped so as impede higher specific-gravity material from walking out of a preceding continuous material-collection repository 704 or 708. Moreover, the continuous material-collection repository 708 is lower than the continuous material-collection repository 704 such that successive material-collection repository stages are formed.

Linkages 714, connected to a motor and cam (not shown), impart reciprocal angular motion to the circular disc 702. As above, other mechanisms can be employed to impart motion to the circular disc 702 as desired. Other features similar to those of the system 600 and not explicitly shown in FIGS. 8-9 can be adapted for use with the radial system 700 without departing from principles of the invention.

During operation of the radial system 700, material is fed by the hopper 14 to a center area 712 of the circular disc 702, the circular disc 702 being illustrated as submerged in a liquid. The material propagates outwardly toward the continuous material-collection repository 704 responsive to gravity and the motion imparted to the circular disc 702 via the linkages 714. In a typical embodiment, the center area 712 includes a level portion that serves to provide a surface on which material fed from the hopper 14 can become more evenly angularly distributed before progressing radially outward and downward on the circular disc 702. Responsive to gravity and the imparted motion, higher specific-gravity material of the material works its way downward (generally direction 50 in FIG. 9) in the continuous material-collection repository 704 and lower specific-gravity material of the material is displaced up (generally direction 55 in FIG. 9) and over the continuous edge 706 by the higher specific-gravity material. In similar fashion, higher specific-gravity material of the material that escapes from the continuous material-collection repository 704 works its way toward and can be captured by the continuous material-collection repository 708 in similar fashion to the above. In other embodiments, any number of successive material-collection repositories can be added to either the system 600 or the radial system 700 as desired.

Lower specific-gravity material of the material that is displaced from the continuous material-collection repository 708 and falls outside an outer edge 717 of the circular disc 702 falls onto a sloped bottom surface 718 of a tank 720 of the radial system 700. The lower specific-gravity material on the sloped surface 718 moves as indicated by the arrows 722 toward a wet belt 716. The wet belt 716 transports the lower specific-gravity material out of the tank 720. As discussed above with regard to the system 600, a tank 720 and use of liquid therein are optional and can be employed or not as part of the system 700 as desired in accordance with design constraints.

Figure 10:
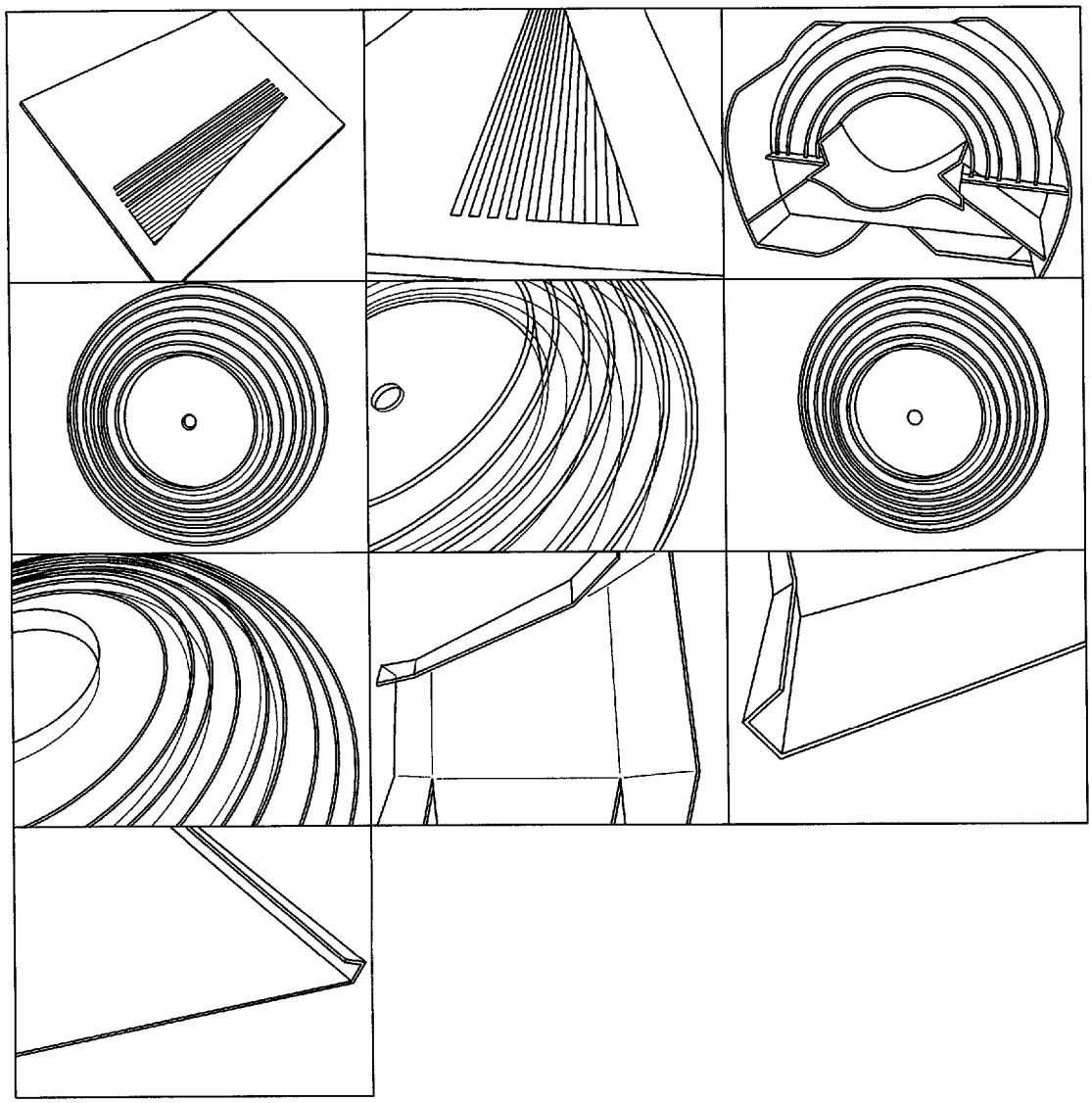
FIG. 10 illustrates various embodiments of material flow-path surfaces.
Figure 11:
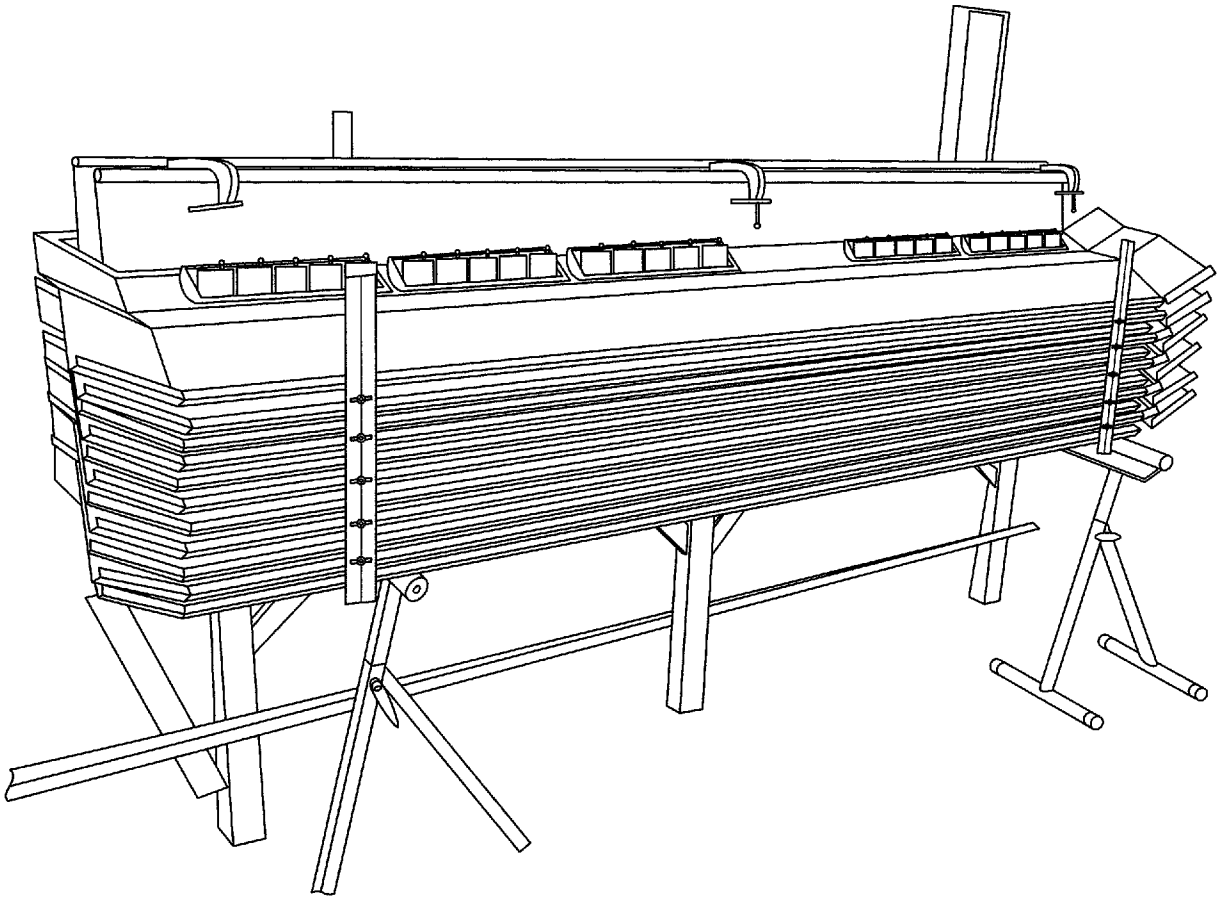
FIG. 11 is a perspective view of a layered material flow-path surface.

FIGS. 10-11 illustrate various portions of different illustrative embodiments of the invention. In FIG. 11, a plurality of layered material flow-path surfaces are employed in which different ones of the layered material flow-path surfaces may be fed by different material conduits and/or by a single material conduit.

In one embodiment associated with FIG. 11, material fed into the upper section of the illustrated embodiments are split by one or more conduits and/or rechanneled to lower levels. It is generally desirable for the structure to be shaped and sized such that the material is distributed evenly as it is rechanneled.

On each level there is a generally flat area to allow for more even distribution. There is a sloped area in communication with the generally flat area that then accelerates the material to allow it to flow in a thin layer down the slope. As the material builds up at a separation channel terminating the sloped area the heavies will more readily stay down and the lights will more easily move upward and eventually over a cavity edge. Accordingly, material can be processed in parallel with only a small working area required.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate circular paths, it is envisioned that there may be helical or spiral paths for the materials to traverse. Further, it may be that there is an asymmetric oscillation of the platform/base/bed such that material may be biased to travel in a particular direction. In the case of the spiral or helical path, there may also be one or more traps or paths resulting in "dead ends" wherein heavy materials may be trapped. Then asymmetric oscillation may be applied in an opposite direction to cause the heavy materials to leave traps. There may be paths accessible in such a direction that lead to recovery bins or otherwise permit the heavy materials to be offloaded (pumped away, trapped, conveyed, etc.) from the structure.

Additionally, although the figures illustrate generally rectangular and circular platforms, the possible shapes of such are plethoric.

Further, oscillation may be linear, angular, radial, circular, or otherwise in any direction. Oscillation may be asymmetrically applied and thereby induce particle flow in a particular direction or path.

Still further, surfaces/platforms may be sloped or flat or combinations thereof. They may be submerged in a fluid or not. There may be multiple surfaces that may cooperate to separate materials.

Finally, it is envisioned that the components of the device may be constructed of a variety of materials, including but not limited to sheet metal, ceramics, resins, plastics, natural fibers, wood, woven materials and the like composites and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A system for separating materials of different specific gravities, comprising:

a) a material feed device configured to feed particulate material;

b) a material flow-path surface submerged in a non-flowing fluid bath in communication with the material feed device such that particulate material fed therefrom is received by the material flow-path surface, wherein the material flow-path surface includes a material trap structure and a circular disc that is sloped downwardly from its center and including a continuous trough about the edge region thereof, the continuous trough having an inward facing lip; and c) an oscillator functionally coupled to the material flow-path surface and configured to cause the material flow-path surface to oscillate, wherein the system does not include a flowing fluid in communication therewith.

2. The system of claim 1, wherein the material flow path surface is in the shape of a conical disc.

3. The system of claim 1, wherein the material feed device is positioned in relation to the material flow path surface to deposit particulate material in a top center region of the material flow path surface.

4. The system of claim 1, wherein the material flow path surface includes a plurality of nested circular discs.

5. The system of claim 1, wherein the oscillator causes rotational oscillation of the material flow path surface.

6. The system of claim 1, wherein the material flow path surface includes a sloped surface leading to a plurality of successive material collection repositories.

7. The system of claim 1, wherein the material flow path surface includes a conical disc sloping downwardly from its center and having a continuous trough about the edge region thereof, the continuous trough having an inward-facing lip.

8. A method of separating materials of different specific gravities, comprising the steps of:

a) feeding particulate material onto a material flow-path surface having a material trap structure and a circular disc that is sloped downwardly from its center and including a continuous trough about the edge region thereof, the continuous trough having an inward facing lip, wherein the material flow-path surface is immersed in a standing fluid; and b) oscillating the material flow-path surface, thereby trapping heavier particles within the material trap structure.

9. The method of claim 8, wherein the standing fluid is selected from the group of fluids consisting of: air, water, and oil.

10. The method of claim 8, wherein the step of feeding particulate material includes feeding particulate material into a central region of a flow path surface that slopes downwardly therefrom.

11. The method of claim 8, wherein the step of oscillating includes both rotational and vertical oscillating.

12. The method of claim 8, wherein the step of oscillating includes rotational oscillating.

13. The method of claim 8, wherein the step of feeding particulate material includes feeding particulate material into a central region of a flow path surface that slopes downwardly therefrom and wherein the step of oscillating includes rotational oscillating.

14. A material separation apparatus, comprising:

a) an oscillation module configured to impart an oscillating force;

b) a control module functionally coupled to the oscillation module and configured to control operation of the oscillation module; and c) a material flow-path surface submerged in a non-flowing fluid bath having a material trap functionally coupled to the oscillation module and a circular disc that is sloped downwardly from its center and including a continuous trough about the edge region thereof, the continuous trough having an inward facing lip, such that it is thereby oscillated.

15. The apparatus of claim 14, wherein the surface includes conic disc having a series of successive material collection repositories having inward facing lips.

16. The apparatus of claim 15, wherein the oscillator causes rotational oscillation of the disc.

17. The apparatus of claim 16, wherein the surface further comprises an array of nested conic discs.

18. The apparatus of claim 17, further comprising a tank of standing fluid disposed about the surface, the surface being submerged therein.

* * * * *